US005253854A

United States Patent [19]

Tanoue et al.

[11] Patent Number: 5,253,854

[45] Date of Patent: Oct. 19, 1993

[54] SHEET FEEDING APPARATUS

[75] Inventors: Masahide Tanoue; Hiroyuki Ishii; Harukazu Sekiya, all of Yokohama; Ryukichi Inoue, Kawasaki; Kazuhide Kudo, Higashi Murayama, all of Japan

[73] Assignee: Canon Kabushiki Kaisha, Tokyo, Japan

[21] Appl. No.: 852,998

[22] Filed: Mar. 17, 1992

[30] Foreign Application Priority Data

Mar. 19, 1991 [JP] Japan ..... 3-080730
Jun. 25, 1991 [JP] Japan ..... 3-180257

[51] Int. Cl.[5] ..... B65H 5/00

[52] U.S. Cl. ..... 271/10; 271/121; 271/122; 271/124; 271/125; 271/118; 271/127; 271/251

[58] Field of Search ..... 271/117, 118, 121, 124, 271/127, 242, 251, 10, 122, 125, 126

[56] References Cited

U.S. PATENT DOCUMENTS 4,432,541 2/1984 Clark et al. ..... 271/251
4,953,846 8/1988 Azeta et al. .
5,026,043 6/1991 Tanjo et al. ..... 271/121

FOREIGN PATENT DOCUMENTS 0279402 8/1988 European Pat. Off. .
0347887 12/1989 European Pat. Off. .
0349013 1/1990 European Pat. Off. .
49105 5/1991 Japan ..... 271/117

*Primary Examiner*—H. Grant Skaggs
*Attorney, Agent, or Firm*—Fitzpatrick, Cella, Harper & Scinto

[57] ABSTRACT

A sheet feeding apparatus comprising a sheet supporting device for stacking and supporting sheets, a sheet supplying device for feeding out the sheets supported by the sheet supporting device, a separating device for separating the sheets fed by the sheet supplying device one by one, a back tension releasing device for not acting a back tension on the sheet separated by the separating device, and a double feed preventing device, which is insertable into and retractable from a sheet feeding path for the sheet separated by the separating device. When the back tension is released by the back tension releasing device, the double feed preventing device is inserted into the sheet feeding path, thereby preventing the double feed of the sheets.

40 Claims, 17 Drawing Sheets

SHEET FEEDING APPARATUS

BACKGROUND OF THE INVENTION

1. Field of the Invention

The present invention relates to a sheet feeding apparatus used with an image forming system such as a copying machine, laser beam printer and other equipment using sheets, and an image forming system using such sheet feeding apparatus. More particularly, the present invention relates to a sheet feeding apparatus wherein sheets stacked on a sheet stacking plate are separated one by one by means of a sheet separating and supplying means comprising sheet supply rollers and separating members urged against each other with a predetermined pressure and the separate sheet is fed by means of a conveying means disposed at a downstream side of the separating and supplying means in a sheet feeding direction, and an image forming system using such sheet feeding apparatus.

The sheet used in the sheet feeding apparatus may be a transfer sheet, recording sheet, printing sheet, OHP sheet, original, post card, envelope, card, film or the like. Material of the sheet is not limited to paper, but may be plastic, metal, cloth or the like. Further, not only a single sheet, but also a multi-sheet such as slips or pamphlets bound together.

2. Related Background Art

A conventional sheet feeding apparatus of the above-mentioned kind is schematically shown in FIG. 12. In FIG. 12, the reference numeral 21 denotes a sheet supply shaft; 22 denotes an eccentric sheet supply roller (feeding member) integrally formed with the sheet supply shaft substantially at its control portion; 23 denotes a pair of idler rollers rotatably and concentrically mounted on the sheet supply shaft 21 on both sides of the eccentric sheet supply roller (only one of which is shown in FIG. 12); 24 denotes a pair of eccentric cams integrally formed with the sheet supply shaft 21 at both its ends (only one of which is shown in FIG. 12). The pair of eccentric cams 24 have the same configuration and are disposed on both ends of the sheet supply shaft 21 with the same phase, and are positioned in correspondence with upwardly directing projections 28*a* formed on both leading ends of a sheet stacking plate 28 which will be described later. The eccentric sheet supply roller 22 has a configuration substantially the same as those of the eccentric cams 24, and is disposed on the sheet supply shaft 21 with the phase offset from the eccentric cams 24 by generally 180 degrees. A larger diameter portion 22*a* of the sheet supply roller has a diameter slightly larger than those of the idler rollers 23 so that an outer peripheral surface of the larger diameter portion 22*a* is protruded outwardly from those of the idler rollers 23.

The reference numeral 26 denotes a separating pad disposed at a downstream side of the idler rollers 23; 25 denotes a separating pad receiving member; and 27 denotes a bias spring for urging the pad receiving member upwardly. The separating pad 26 is urged against lower surfaces of the idler rollers 23 by means of the bias spring 27. The reference numeral 28 denotes the above-mentioned sheet stacking plate a rear end of which is rotatably supported on a shaft 30 for pivotal movement around the shaft 30 in an up-and-down direction; and 29 denotes a bias spring for urging the sheet stacking plate upwardly so that the sheet stacking plate 28 is always biased for upward pivotal movement around the shaft 30.

FIG. 12 shows a sheet supply waiting condition in which the eccentric cams 24 are oriented leftwardly and downwardly so that larger diameter portions of the cams urge the projections 28*a* of the sheet stacking plate 28 downwardly, thereby rocking the sheet stacking plate 28 downwardly around the shaft 30 in opposition to the bias spring 29. In this condition, the separating pad 26 is abutted against the lower surfaces of the idler rollers 23, and the eccentric sheet supply roller 22 is oriented rightwardly and upwardly with the phase offset from the eccentric cams 24 by generally 180 degrees. Sheets P are stacked on the sheet stacking plate 28.

In the sheet supply waiting condition shown in FIG. 12, when a sheet supply start signal is emitted, the sheet supply shaft 21 is rotated by one revolution in a clockwise direction via a drive means and a one-revolution clutch mechanism (both not shown), so that the eccentric cams 24 and the eccentric sheet supply roller 22 are also rotated by one revolution, together with the sheet supply shaft 21.

(1) At an initial phase of this one revolution, the downward urging force of the eccentric cams 24 against the sheet stacking plate 28 is released, with the result that the sheet stacking plate is rocked upwardly by the spring 29, thereby abutting a leading end portion of the sheet stack P rested on the sheet stacking plate against the lower surfaces of the idler rollers 23.

(2) During a further rotation in the one revolution, a sheet supply start end 22*b* of the larger diameter portion 22*a* of the eccentric sheet supply roller 22 is urged against the leading end portion of the sheet stack P rested on the sheet stacking plate 28, as shown in FIG. 13, thereby applying a sheet feeding force to an uppermost sheet on the sheet stack, with the result that a further rotation of the eccentric sheet supply roller 22 causes the uppermost sheet to be fed toward the separating pad 26 and be passed between the separating pad 26 and the eccentric sheet supply roller 22 together with the larger diameter portion 22*a*. In this case, the other sheets are prevented from passing between the separating pad 26 and the eccentric sheet supply roller 22 by the separating pad 26, with the result that only the uppermost sheet contacting the larger diameter portion 22*a* of the eccentric sheet supply roller 22 can be separated from the other sheets.

(3) When a sheet supply finish end 22*c* of the larger diameter portion 22*a* of the eccentric sheet supply roller 22 has been passed through the separating pad 26 as shown in FIG. 14, the separated uppermost sheet is guided by a guide 31 to reach a nip between a pair of register rollers 32 now stopped. During a further sheet feeding operation, a loop is formed in the sheet between the paired register rollers 32 and a contacting point between the separating pad 26 and the eccentric sheet supply roller 22. Due to the reaction force from the loop, a leading end of the sheet is abutted against the nip line of the paired register rollers 32 along the whole length of the leading end, thereby performing the registration of the sheet. After the sheet supply finish end 22*c* of the larger diameter portion 22*a* of the eccentric sheet supply roller 22 has passed through the separating pad 26, the sheet feeding force does not act on the sheet, so that the sheet is maintained to be pinched between the idler rollers 23 and the separating pad 26.

(4) After the registration of the sheet by the register rollers 32 has finished, at a predetermined control timing, the register rollers 32 are rotated to feed the sheet. In this sheet feeding operation, the loop in the sheet is firstly eliminated first, and then, the sheet is subjected to a pulling force, so that the sheet is pulled off from the contacting portions between the idler rollers 23 and the separating pad 26 (FIG. 15). The idler rollers are rotatingly driven by the pulled sheet.

(5) When one revolution of the sheet supply shaft 21 is finished, the eccentric cams 24 again urge the sheet stacking plate 28 downwardly in opposition to the spring 29, and the eccentric cams 24 and the eccentric sheet supply roller 22 are returned to the sheet supply waiting condition shown in FIG. 12. At this point, even if a trailing end of the sheet (fed by the register rollers 32) has not yet been passed through the contacting portions between the idler rollers 23 and the separating pad 26, the sheet continues to be fed. When the trailing end of the sheet has just passed through the contacting portions between the separating pad 26 and the idler rollers 23, these rollers 23 are stopped. Further, when the trailing end of the sheet passes through the register rollers 32, the latter is also stopped, with the result that the sheet feeding apparatus is maintained to the sheet supply waiting condition until the next sheet supply start signal is emitted.

The above-mentioned sheet feeding apparatus has the following problem. That is to say, as mentioned in the above item (4), after the separated sheet is registered by the paired register rollers 32 and is fed by these rollers, the sheet (after elimination of the loop) is pulled in opposition to a pinching force from the contacting portions between the idler rollers 23 and the separating pad 26. The pinching force acts on the sheet as a back tension. The back tension is determined by the pressure and coefficient of friction of the separating pad 26, and accordingly, when the pressure of the separating pad is increased due to the insufficient manufacturing accuracy of the pad or when the coefficient of friction of the separating pad is increased in accordance with the circumstances, the back tension is also increased. As a result, the trailing end of the sheet after registration is pulled back, thus deteriorating the registration of the sheet P. Thus, when such sheet feeding apparatus is used with an image forming system, an image quality is worsened, and/or the discrepancy in image occurs, thus leading to the detrimental reduction in the image quality.

It is considered that, when the sheet after registration is fed by the register rollers 32, the idler rollers 23 and the separating pad 26 are separated from each other to release the pinching force, thereby preventing the back tension from acting on the sheet. However, if the idler rollers 23 and the separating pad 26 are separated from each other, a next sheet will be adhered to the fed sheet due to the electrostatic force and the like, thus causing the following double feed.

SUMMARY OF THE INVENTION

The present invention aims to eliminate the above-mentioned drawback, and an object of the present invention is to prevent the following double feed even when a sheet is not subjected to a back tension.

To achieve the above object, the present invention provides a sheet feeding apparatus comprising a sheet supporting means for stacking and supporting sheets, a sheet supplying means for feeding out the sheets supported by the sheet supporting means, a separating means for separating the sheets fed by the sheet supplying means one by one, a back tension releasing means for not applying a back tension on a separated sheet, and a double feed preventing means, which is insertable into and retractable from a sheet feeding path. Wherein, when the back tension is being released by the back tension releasing means, the double feed preventing means is inserted into the sheet feeding path, thereby preventing the double feed.

The back tension acting on the fed sheet may be created by a pinching force due to a sheet supply pressure generated between the sheet supplying means and the sheet or by a pinching force due to a separating force of the frictional separating means, for example.

With the arrangement as mentioned above, when the back tension created by the above-mentioned pinching force and the like is released by the back tension releasing means, by inserting the double feed preventing means into the sheet feeding path, it is possible to prevent the following double feed of the sheets.

Particularly, in a sheet feeding apparatus using a separating pad as the frictional separating means, since the friction force is great, the sheet was apt to be skew-fed or a driving force of a downstream conveying means had to be set greater due to the greater back tension. However, in the present invention, since the sheet is not subjected to the back tension by separating the separating pad from the sheet and the following double feed is prevented by the double feed preventing means, it is possible to feed the sheet straightly and to set the driving force of the conveying means smaller, thus providing an inexpensive sheet feeding apparatus.

DETAILED DESCRIPTION OF THE PREFERRED EMBODIMENTS

First of all, a first embodiment (FIGS. 1 to 5) of the present invention will be explained.

Figure 1:
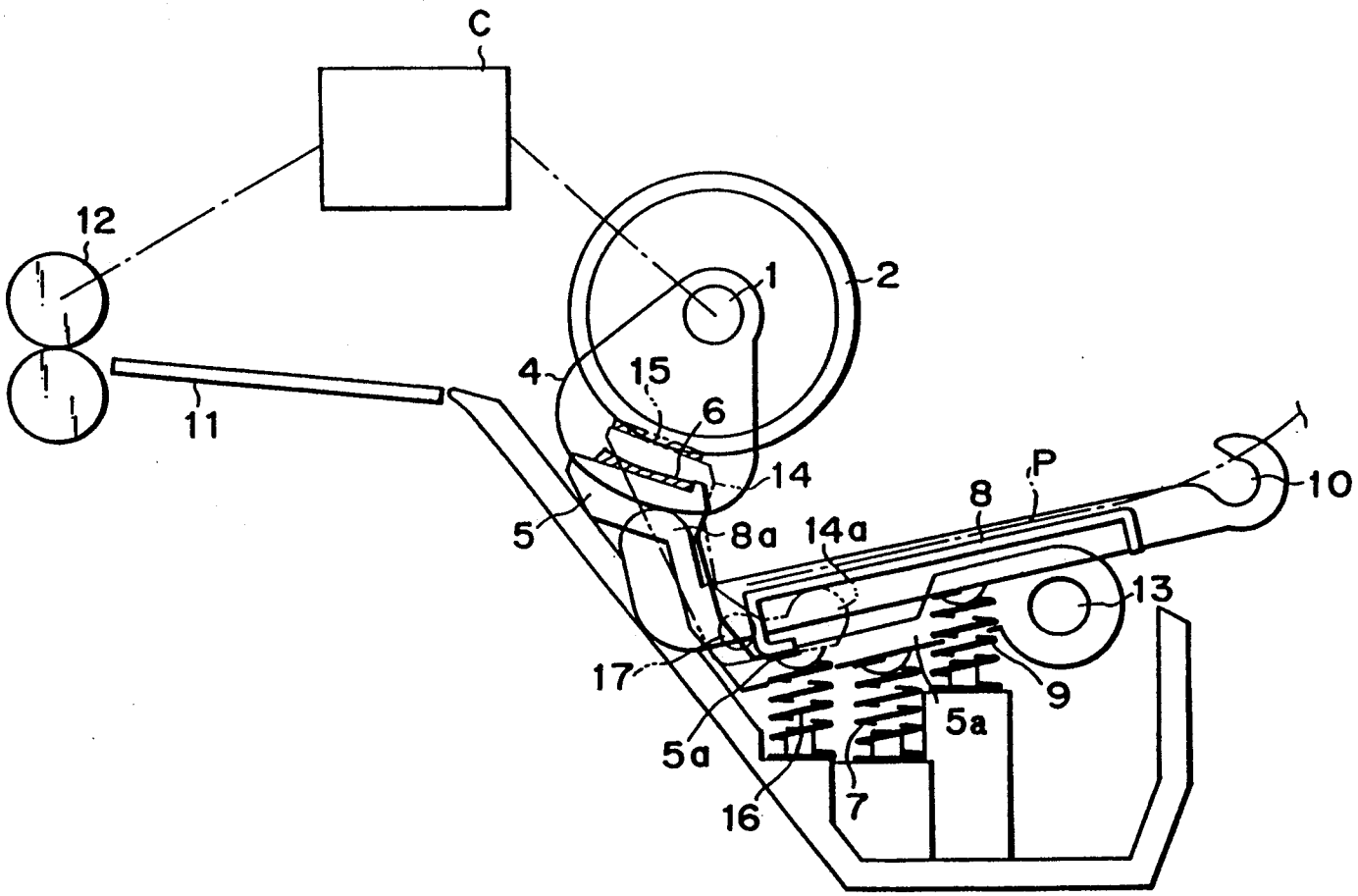
FIG. 1 is a schematic elevational sectional view of a sheet feeding apparatus according to a preferred embodiment of the present invention in a sheet supply waiting condition.

FIG. 1 is a schematic elevational sectional view of a sheet feeding apparatus according to the first embodiment of the present invention. In FIG. 1, a sheet supply roller 2 is concentrically and fixedly mounted on a sheet supply shaft 1, and a pair of eccentric cams 4 are also fixedly mounted on the sheet supply shaft 1 at both ends thereof (only one of the cams is shown in FIG. 1). The pair of eccentric cams 4 have the same configuration and the same angular phase and are disposed in confronting relation to upwardly directed projections 8*a* formed on a sheet stacking plate 8 at both lateral edges of a front end of the plate, respectively. The sheet stacking plate 8 is rotatably supported by a shaft 10 at its rear end portion so that it can be rocked around the shaft 10 in an up-and-down direction. The sheet stacking plate 8 is biased by a spring 9 so that the plate is always biased upwardly around the shaft 10 by the spring 9. FIG. 1 shows a sheet supply waiting condition. In this condition, the eccentric cams 4 are oriented leftwardly and downwardly so that the cams urge the upwardly directed projections 8*a* of the sheet stacking plate 8 downwardly in opposition to the bias spring 9.

The reference numeral 6 denotes a separating pad (separating member) to be urged against a lower surface of the sheet supply roller 2 acting as a sheet supplying member; and 5 denotes a pad receiving member having a free end on which the separating pad 6 is mounted. The pad receiving member 5 is rotatably mounted on a shaft 13 so that it is always biased to be rotated in a clockwise direction around the shaft 13 by a spring 7. In the condition shown in FIG. 1, the pad receiving member is abutted, at 5*a*, against an undersurface of a front end portion of the sheet stacking plate 8, which is now held at a lowered position, and is held there, with the result that the separating pad 6 is kept in a lowered position where it is spaced apart from the lower surface of the sheet supply roller 2.

Figure 2:
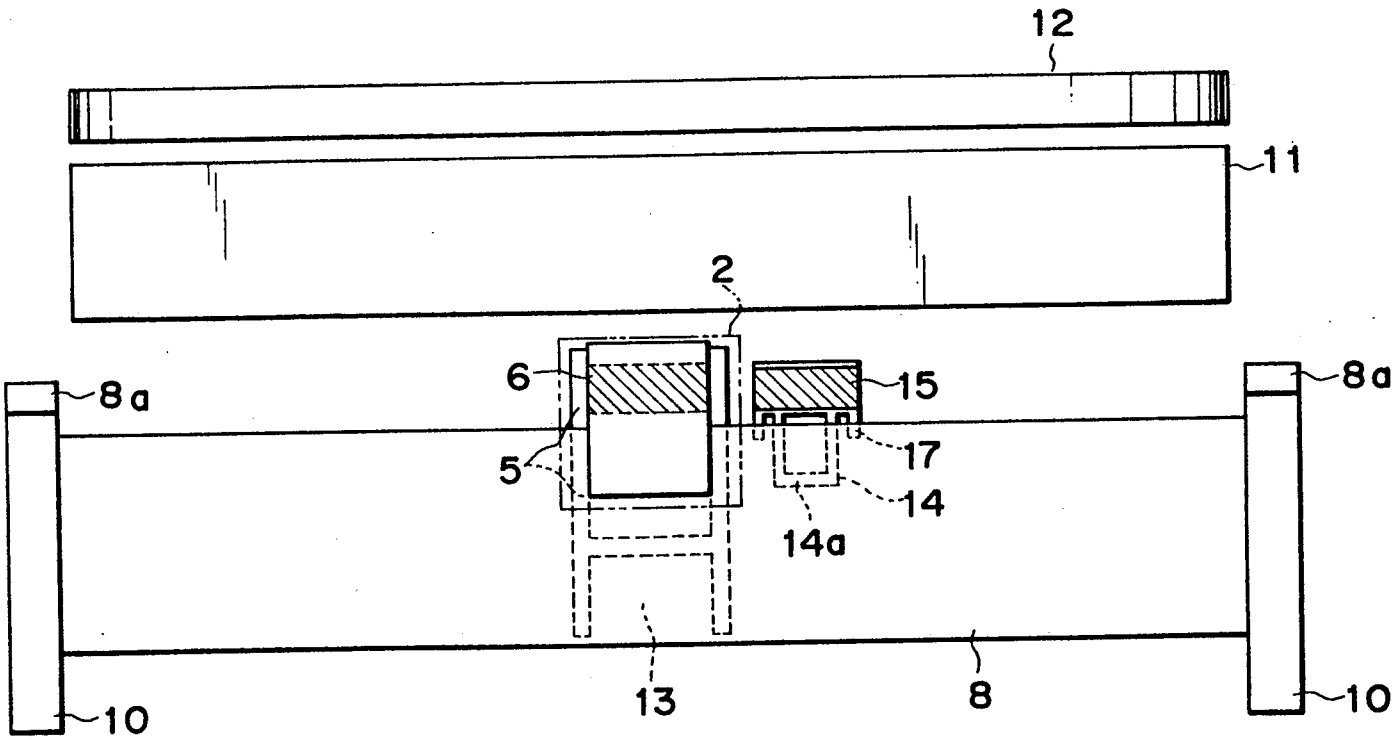
FIG. 2 is a plan view showing a separating pad and a sub-separating pad.
Figure 3:
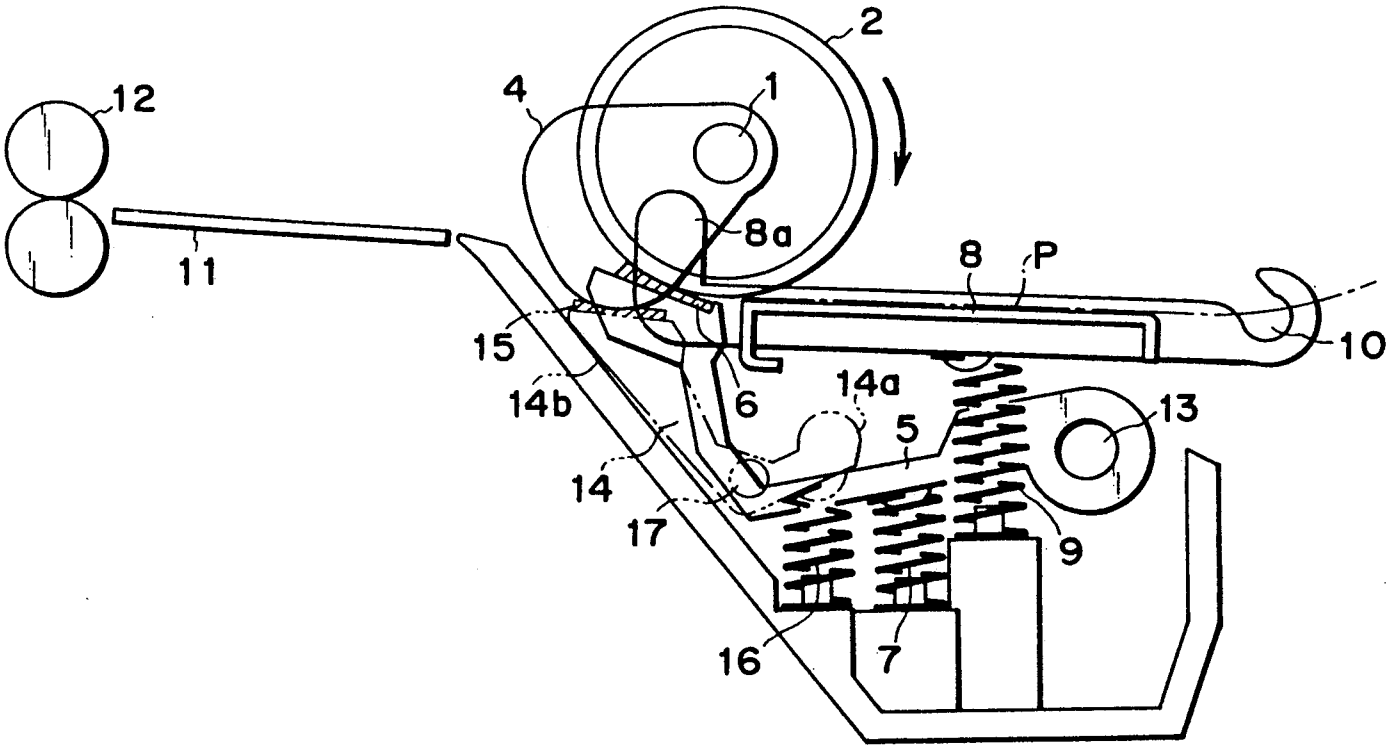
FIG. 3 is an elevational sectional view of the sheet feeding apparatus in a condition that a downward urging force for a sheet stacking plate is released.

A sub-separating pad 15 (following double feed preventing member) is disposed in the proximity of the sheet supply roller 2 in a non-confronting and non-contacting relation thereto, as shown in FIG. 2, and is held by a sub-separating pad receiving member 14. The receiving member 14 is always biased to be rotated in an counter-clockwise direction around a shaft 17 by a spring 16. In the condition shown in FIG. 1, an arm 14*a* (opposite to the pad) of the receiving member 14 is abutted against the undersurface of the front end portion of the sheet stacking plate 8 which is now held at the lowered position, and is held there, with the result that the sub-separating pad 15 is protruded or inserted into a sheet feeding path passing between the sheet supply roller 2 and the separating pad 6.

In the sheet supply waiting condition shown in FIG. 1, when a sheet supply start signal is emitted from a control means C, the sheet supply shaft 1 is rotated by one revolution in a clockwise direction via a drive means and a one-revolution clutch mechanism (both not shown), so that the sheet supply roller 2 and the eccentric cams 4 are also rotated by one revolution.

(1) At an initial phase of this one revolution, the downward urging force of the eccentric cams 4 against the sheet stacking plate 8 is released (FIG. 3), with the result that the sheet stacking plate 8 is rocked upwardly by the spring 9, thereby abutting an upper surface of a leading end portion of a sheet stack P rested on the sheet stacking plate 8 against the lower surface of the sheet supply roller 2 with a predetermined pressure. At the same time, in synchronous with the upward pivotal movement of the sheet stacking plate 8, the separating pad receiving member 5 is rotated in the clockwise direction by the spring 7, thus abutting the separating pad 6 against the lower surface of the sheet supply roller 2 with a predetermined pressure, and the sub-separating pad receiving member 14 is rotated in the anti-clockwise direction by the spring 16 until a portion 14*b* (FIG. 3) of this member 14 is abutted against a frame of the apparatus, thus shifting the sub-separating pad 15 downwardly to retract it from the sheet feeding path passing between the sheet supply roller 2 and the separating pad 6.

(2) During a further rotation in the one revolution, the sheet supply roller 2 is further rotated to apply a sheet feeding force to an uppermost sheet on the sheet stack, with the result that the uppermost sheet is fed toward the separating pad 6 and is passed between the separating pad 6 and the sheet supply roller 2. In this case, the other sheets are prevented from passing between the separating pad 6 and the sheet supply roller 2 by the separating pad 6, with the result that only the uppermost sheet contacting the sheet supply roller 2 can be separated from the other sheets. In this case, as mentioned above, since the sub-separating pad 15 is retracted from the sheet feeding path passing between the sheet supply roller 2 and the separating pad 6, it does not interfere with the sheet and does not apply any load to the sheet.

Figure 4:
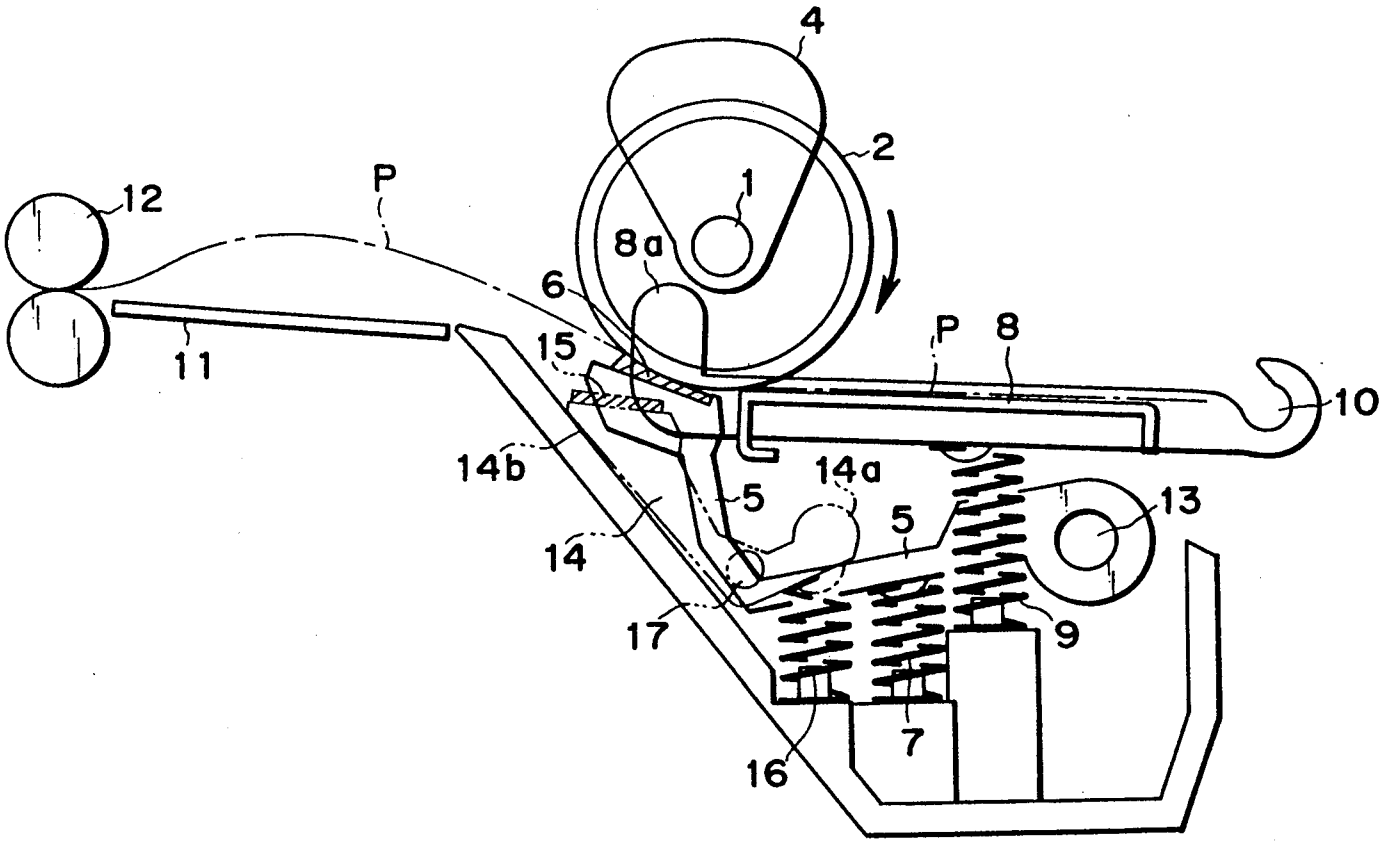
FIG. 4 is an elevational sectional view of the sheet feeding apparatus in a condition that a loop is being formed in a sheet.

(3) The separated sheet is guided by a guide 11 to reach a nip between a pair of register rollers 32 now stopped. During a further sheet feeding operation, as shown in FIG. 4, a loop is formed in the sheet between the paired register rollers 12 and a contacting point between the separating pad 6 and the sheet supply roller 2. Due to the reaction force from the loop, the registration of the sheet is effected.

(4) After the registration of the sheet has been finished, in response to a signal from the control means C at a predetermined control timing, the register rollers 12 are rotated to feed the sheet. During this sheet feeding operation, before the loop in the sheet is eliminated, as shown in FIG. 5, the eccentric cams 4 are rotated downwardly to abut against the projections 8a, thus lowering the sheet stacking plate 8 in opposition to the spring 9. At the same time, the separating pad receiving member 5 is rotated downwardly in the counter-clockwise direction in opposition to the spring 7, thus lowering the separating pad 6 to be separated from the lower surface of the sheet supply roller 2, and the sub-separating pad receiving member 14 is urged by the undersurface of the lowering sheet stacking plate 8 and is rotated around the shaft 17 in the clockwise direction in opposition to the spring 16, with the result that the sub-separating pad 15 is protruded into the sheet feeding path passing between the sheet supply roller 2 and the separating pad 6.

When the separating pad 6 is separated from the sheet supply roller 2, since the pinching force generated at a contacting portion between the sheet supply roller 2 and the separating pad 6 is released, the sheet is not subjected to a back tension due to such pinching force. Further, since the sheet stacking plate 8 is also lowered to release the contacting pressure between the sheet supply roller 2 and the sheet, the sheet is not subjected to a back tension due to such contacting pressure.

Figure 5A:
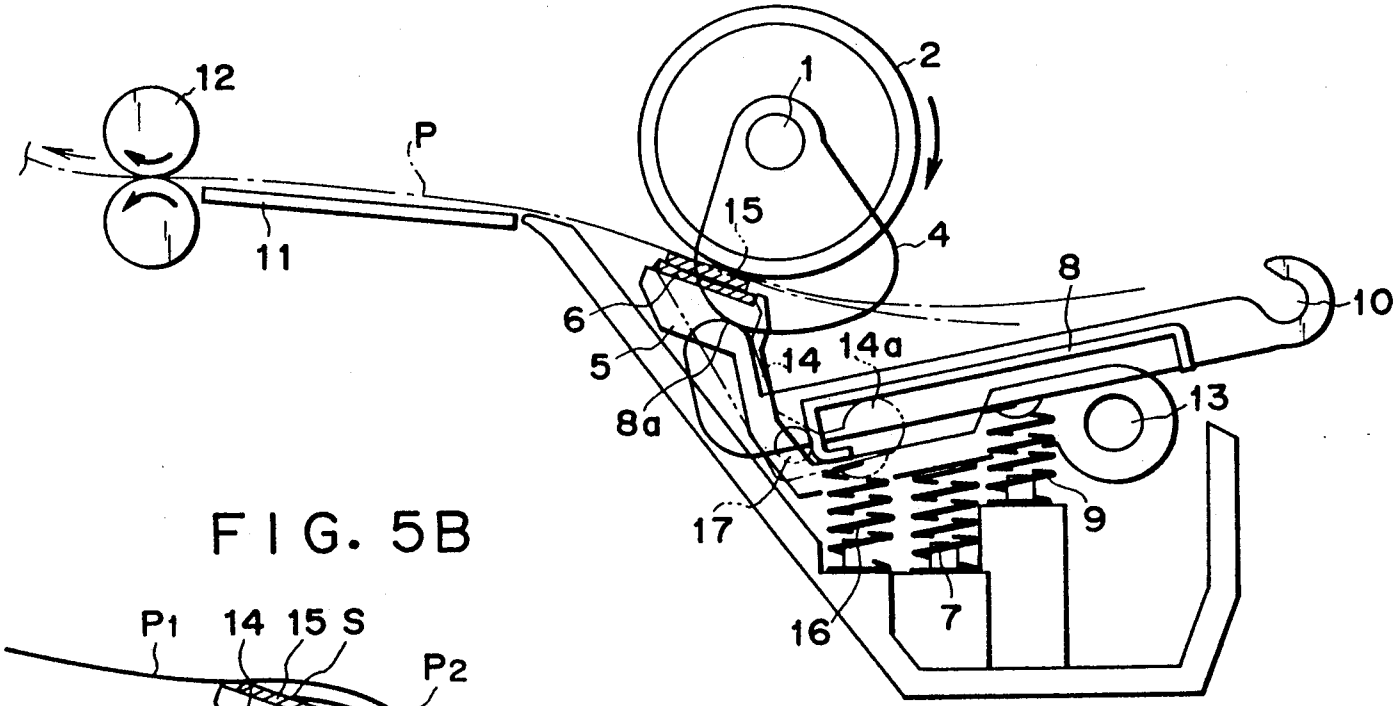
FIG. 5A is an elevational sectional view of the sheet feeding apparatus in a condition that the sheet stacking plate is again urged downwardly near the end of one revolution of a sheet supply shaft.
Figure 5B:
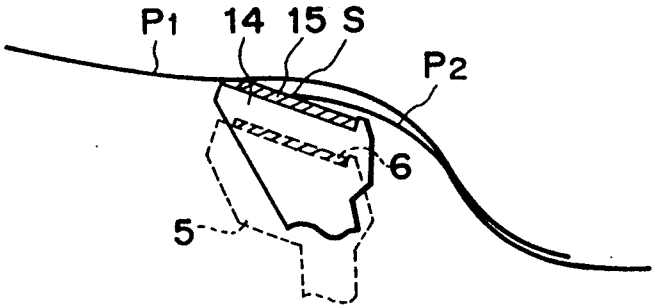
FIG. 5B is a schematic view showing a condition that the following double feed is prevented.

In this case, as shown in FIGS. 5A and 5B, even when the pinching force between the sheet supply roller 2 and the separating pad 6 is released, since the sub-separating pad 15 is positioned in the sheet feeding path passing between the sheet supply roller 2 and the separating pad 6, the fed sheet $P_1$ is prevented from adhering to the next sheet $P_2$ by the friction force generated between the sub-separating pad 15 and the next sheet $P_2$, thus preventing the following double feed of the next sheet. Thus, the greater the coefficient of friction of the sub-separating pad 15, the higher the efficiency for preventing the following double feed. Incidentally, in FIG. 5B, a loading end S of the next sheet $P_2$ is prevented from moving by the sub-separating pad 15.

When one revolution of the sheet supply shaft 1 is finished, the eccentric cams 4 are returned to the sheet supply waiting condition shown in FIG. 11. In this point, even if a trailing end of the sheet (fed by the register rollers 12) has not yet been passed through the contacting portion between the sheet supply roller 2 and the separating pad 6, the sheet continues to be fed by the paired register rollers 12. Meanwhile, since the separating pad 6 is spaced apart from the sheet supply roller 2, the fed sheet is not subjected to the back tension. When the trailing end of the sheet passes through the register rollers 12, the latter is stopped, with the result that the sheet feeding apparatus is maintained to the sheet supply waiting condition until the next sheet supply start signal is emitted. Incidentally, if the above-mentioned arrangement is applied to the conventional apparatus having an eccentric sheet supply roller and a pair of idler rollers, a good result will also be obtained.

Incidentally, while the sheet supply roller 2 served to not only feed out the sheet P but also to separate the sheets, an additional separating roller may be provided for cooperating with the separating pad 6 to separate the sheets.

Figure 6:
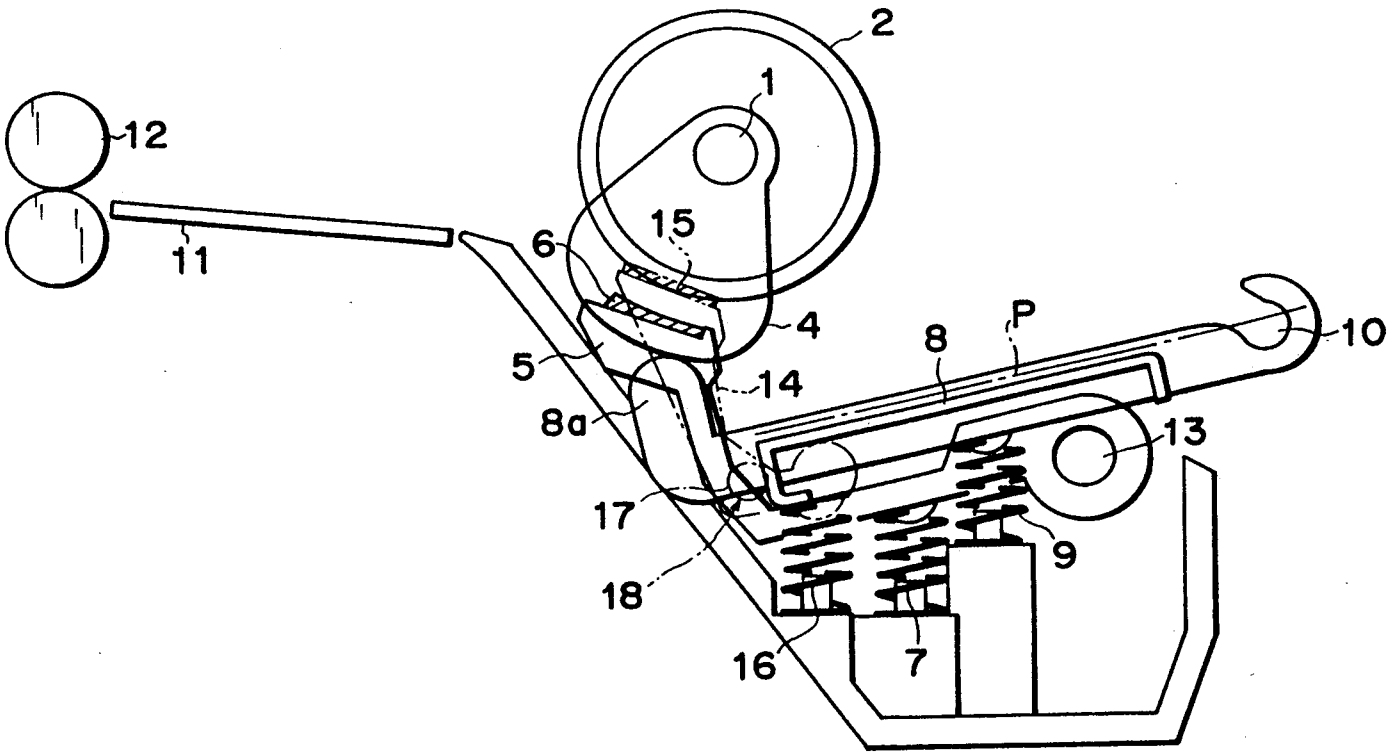
FIG. 6 is a schematic elevational sectional view of a sheet feeding apparatus according to a second embodiment of the present invention.

Next, a second embodiment of the present invention will be explained with reference to FIG. 6.

In this second embodiment, the clockwise pivotal movement of the sub-separating pad receiving member 14 around the shaft 17 in opposition to the spring, i.e., the pivotal movement for inserting the sub-separating pad 15 into the sheet feeding path (passing between the sheet supply roller 2 and the separating pad 6) during the downward pivotal movement of the sheet stacking plate 8 is not effected in synchronous with the lowering movement of the sheet stacking plate 8 as in the first embodiment, but, such clockwise pivotal movement of the sub-separating pad receiving member is effected independently by means of a clutch and solenoid mechanism 18 at a predetermined timing under the one revolution control. Accordingly, in this second embodiment, the sub-separating pad receiving member 14 does not have the arm 14a to be abutted against the sheet stacking plate 8 as in the first embodiment.

In the second embodiment, the sub-separating pad receiving member 14 is rotated in the clockwise direction by the mechanism 18 so that the sub-separating pad 15 is inserted into the sheet feeding path between the sheet supply roller 2 and the separating pad 6 before the separating pad 6 is separated from the sheet supply roller 2.

Figure 7:
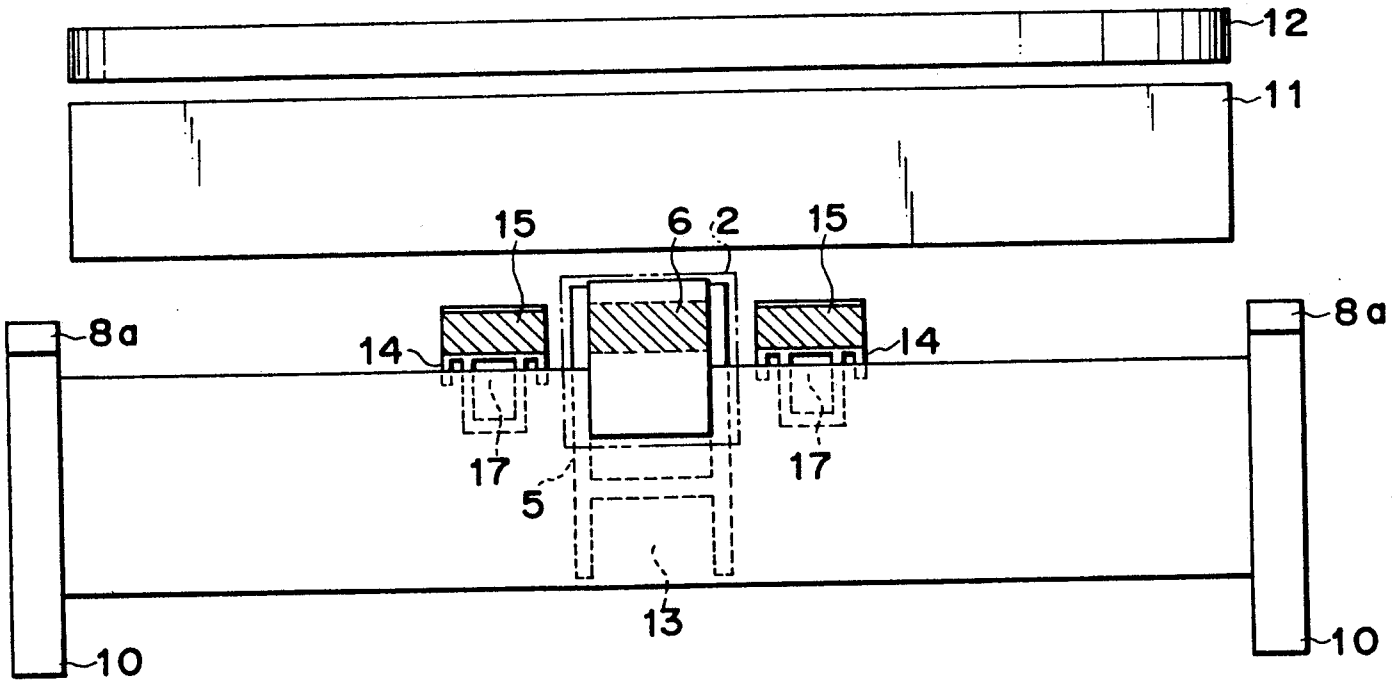
FIG. 7 is a plan view showing a separating pad and sub-separating pads according to a third embodiment of the present invention.

Next, a third embodiment (FIG. 7) of the present invention will be explained.

In this embodiment, a plurality of sub-separating pads 15 are provided. In the illustrated embodiment, two sub-separating pad assemblies are arranged on both sides of the sheet supply roller 2.

Next, a fourth embodiment (FIG. 8) of the present invention will be explained.

Figure 8:
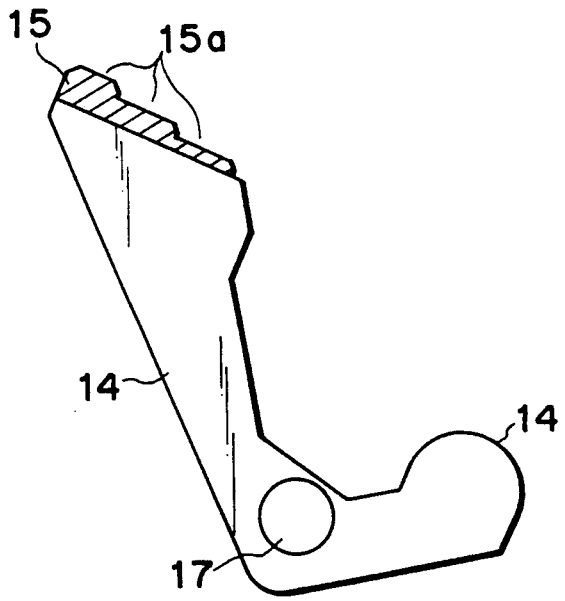
FIG. 8 is a side view showing a sub-separating pad and a receiving member therefor according to a fourth embodiment of the present invention.

In this embodiment, the sub-separating pad 15 has an outer surface including a plurality of stepped projections 15a as shown in FIG. 8 so that it can receive or stop the leading end of the next sheet positively, thus surely preventing the following double feed of the sheets. Incidentally, the sheet supply roller 2 acting as the sheet supplying member may be replaced by a sheet supply belt and the like. Further, the separating pad 6 acting as the separating member and the sub-separating pad 15 acting as the following double feed preventing member may be replaced by rotatable sheet returning rollers or rotating belts. The pair of register rollers 12 acting as the sheet convey rollers may be replaced by a pair of continuously rotating convey rollers or a pair of pinching conveyor belts.

Next, an image forming system using the sheet feeding apparatus of the present invention will be explained.

Figure 9:
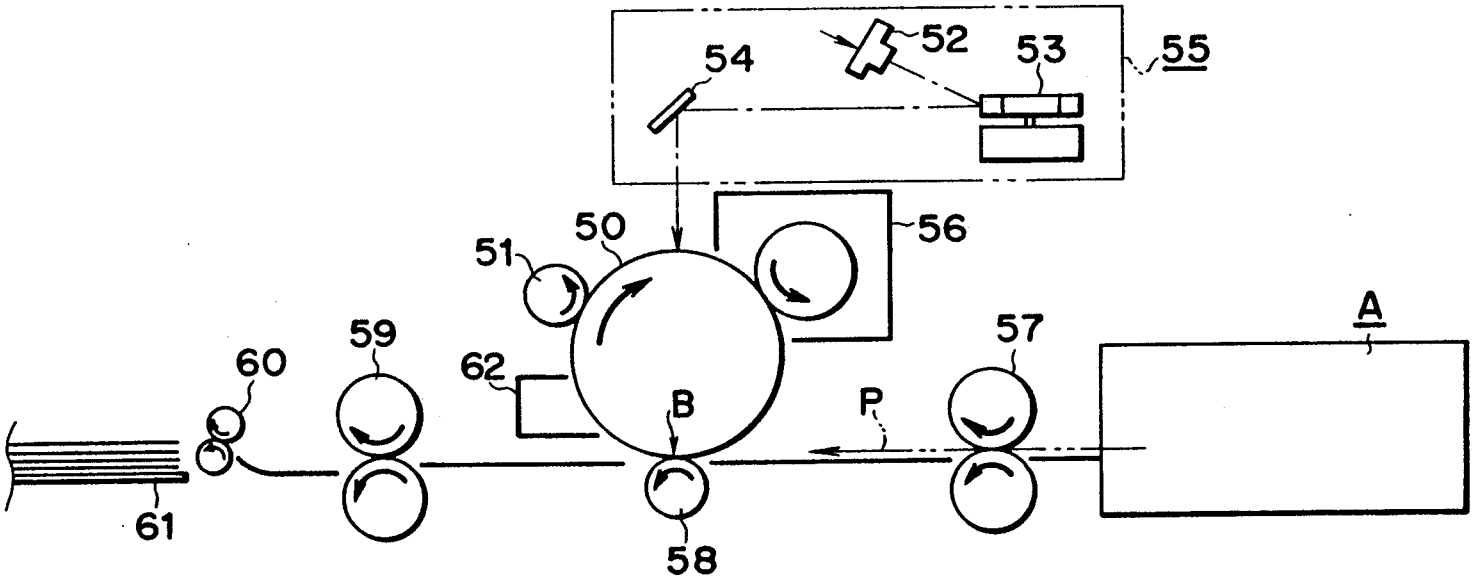
FIG. 9 is a schematic constructural view of an image forming system using the sheet feeding apparatus of FIG. 1.

FIG. 9 is a schematic constructural view of an image forming system using the sheet feeding apparatus according to the first embodiment of the present invention. The illustrated image forming system is a laser beam printer utilizing the electrophotographic process. In FIG. 9, the reference numeral 50 denotes an electrophotographic photosensitive drum rotated in a clockwise direction shown by the arrow at a predetermined peripheral speed (process speed). During the rotation of the drum 50, the drum is uniformly charged with a predetermined polarity and potential by means of a charger roller 51 acting as a charger means.

Then, the charged surface of the drum is illuminated by laser beam scanning exposure light L (for writing an image) emitted from a laser scanner 55 comprising a laser generating element 52, a polygonal scanner 53, an optical element 54 and the like and capable of emitting a laser beam modulated in response to a time sequence electric digital pixel signal regarding image information (to be inputted to a controller (not shown) of the printer from a host equipment (not shown) such as a computer, word processor and the like), thereby forming an electrostatic latent image corresponding to the aimed image information on the peripheral surface of the drum.

Then, the latent image formed on the drum is visualized by a developing device 56 as a toner image. When the toner image reaches a transfer portion B between the opposed drum 50 and transfer roller 58 in consequence of the rotation of the drum, the toner image on the photosensitive drum 50 is transferred onto a recording sheet P (the above-mentioned sheet) supplied from the sheet feeding apparatus A and the fed to the transfer portion B by a pair of register rollers 57 at a predetermined timing. Thereafter, the recording sheet on which the toner image was transferred is separated from the photosensitive drum 50 and is then fed to a fixing device 59, where the transferred image is permanently fixed onto the sheet. Then, the sheet is ejected by ejector rollers 60 onto an ejection tray 61 as a printed matter (print). After passing through the transfer portion B, the surface of the drum 50 is cleaned by a cleaning device 62 so that the residual toner and foreign matters remaining on the drum surface are removed, thus preparing for the next image formation.

Since the sheet feeding apparatus A is the same as that of the first embodiment of the present invention, the detailed illustration thereof is omitted in FIG. 9. The pair of register rollers 57 may be used as the convey rollers 12.(FIG. 1) acting as the conveying means of the sheet feeding apparatus A or may be independently provided from the convey rollers 12.

Next, a fifth embodiment (FIG. 10A) of the present invention will be explained.

Figure 10A:
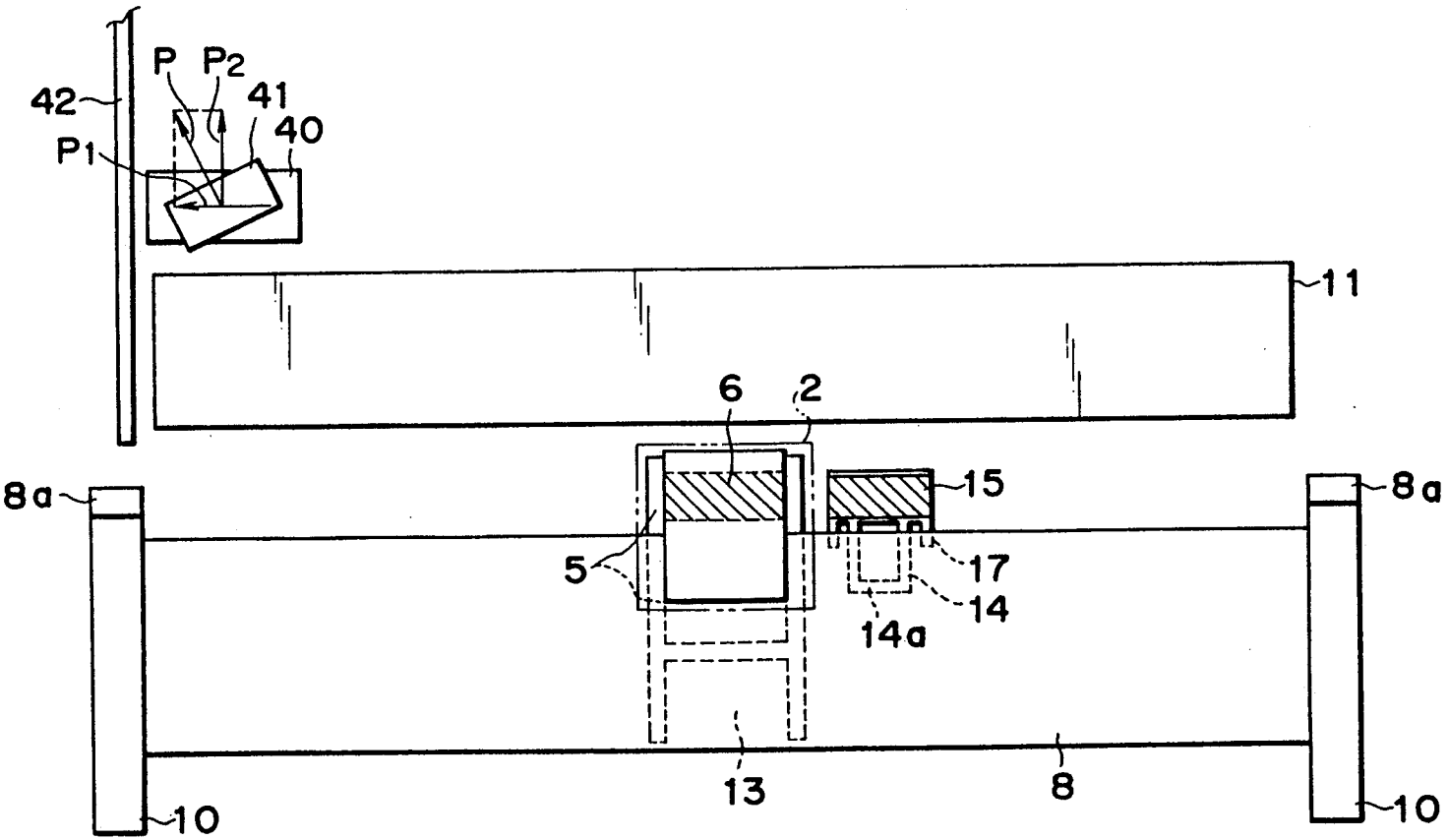
FIG. 10A is a plan view showing a separating pad and a sub-separating pad according to a fifth embodiment of the present invention.

FIG. 10A is a view similar to FIG. 2, but shows a fifth embodiment of the present invention. In this embodiment, in place of the paired register rollers 12, a convey roller 40, a skew-feed roller 41 urged against the convey roller 40 at a predetermined angle, and a reference plate 42 are used. The sheet separated and fed in the same manner as the first embodiment is guided by the guide 11 to reach a nip between the convey roller 40 and the skew-feed roller 41. Now, a predetermined sheet feeding force P is created between the rollers 40, 41, which force P includes a force component $P_1$ directing perpendicular to the sheet feeding direction. The sheet is urged against the reference plate 42 by this force component $P_1$, thus correcting the skew-feed of the sheet in a similar manner as the registration.

In this case, however, since the skew-feed of the sheet is corrected while the sheet is being fed, if the back tension acts on the sheet during this movement, the effect of the back tension will directly affect an influence upon the sheet, thus preventing the proper correction of the skew-feed. To the contrary, if the sheet feeding force P is increased sufficiently to overcome the back tension, the sheet will be urged against the reference plate 42 with excessive pressure, thus bending a corner or edge of the sheet.

Next, a sixth embodiment (FIG. 10B) of the present invention will be explained.

Figure 10B:
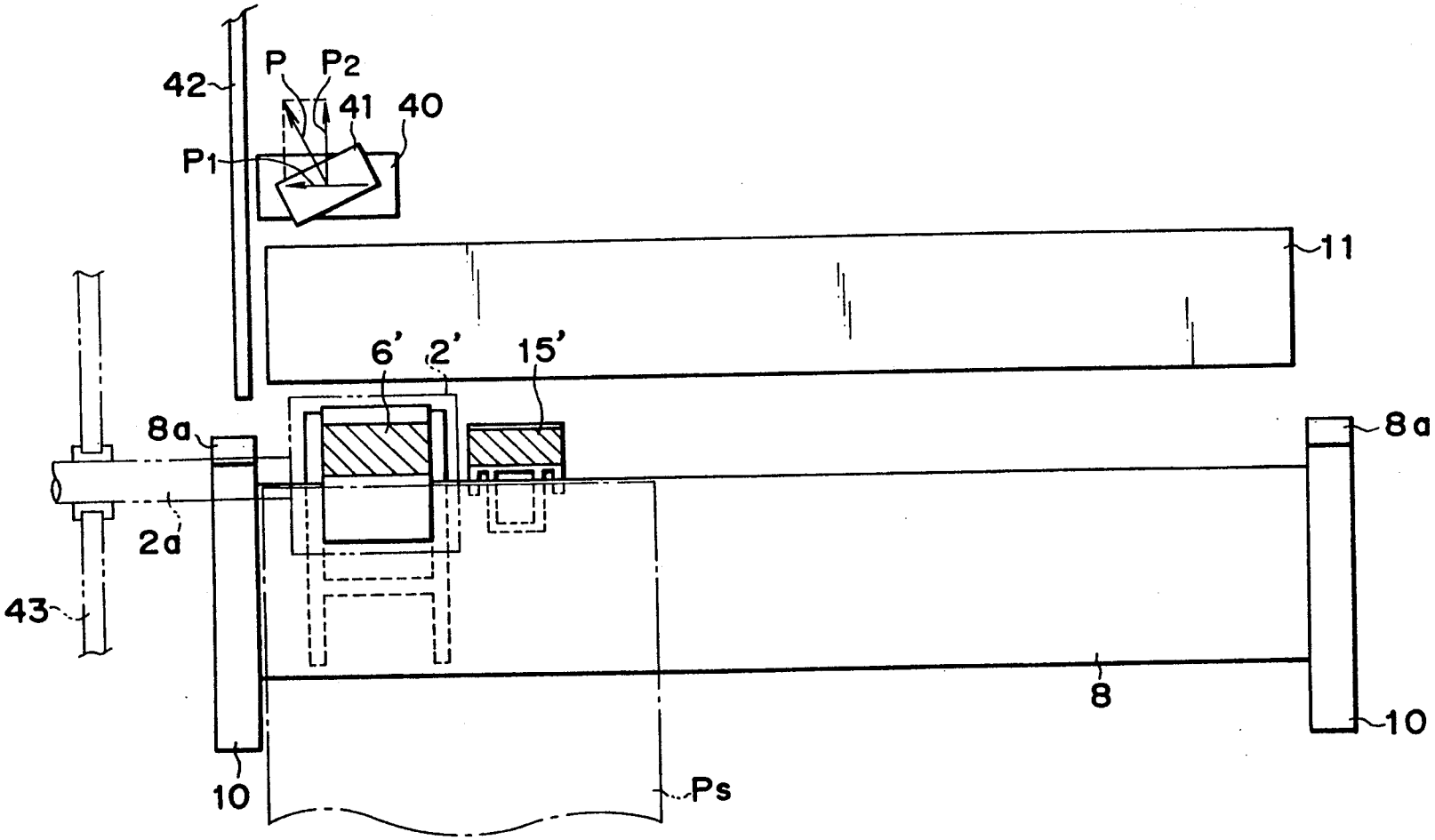
FIG. 10B is a plan view showing a separating pad and a sub-separating pad according to a sixth embodiment of the present invention.

FIG. 10B shows the sixth embodiment of the present invention. As shown by the broken line, a separating pad 6' and a sub-separating pad 15' are disposed at one side of the apparatus to offset from the central position thereof so that these pads can act on the sheet at one lateral edge portion thereof. Further, as shown by the two dot and chain line, a sheet supply roller 2' is disposed in confronting relation to the separating pad 6'.

With this arrangement, when the sheet is fed with one side reference, even if a sheet Ps having a smaller size is used, the sheet can be properly fed. Further, since a length of a driving shaft 2*a* for transmitting a rotational force to the sheet supply roller 2' (distance between a side wall 43 of the apparatus supporting the driving shaft 2*a* and the sheet supply roller 2') can be shorter, the cost of the apparatus can be reduced.

Figure 11A:
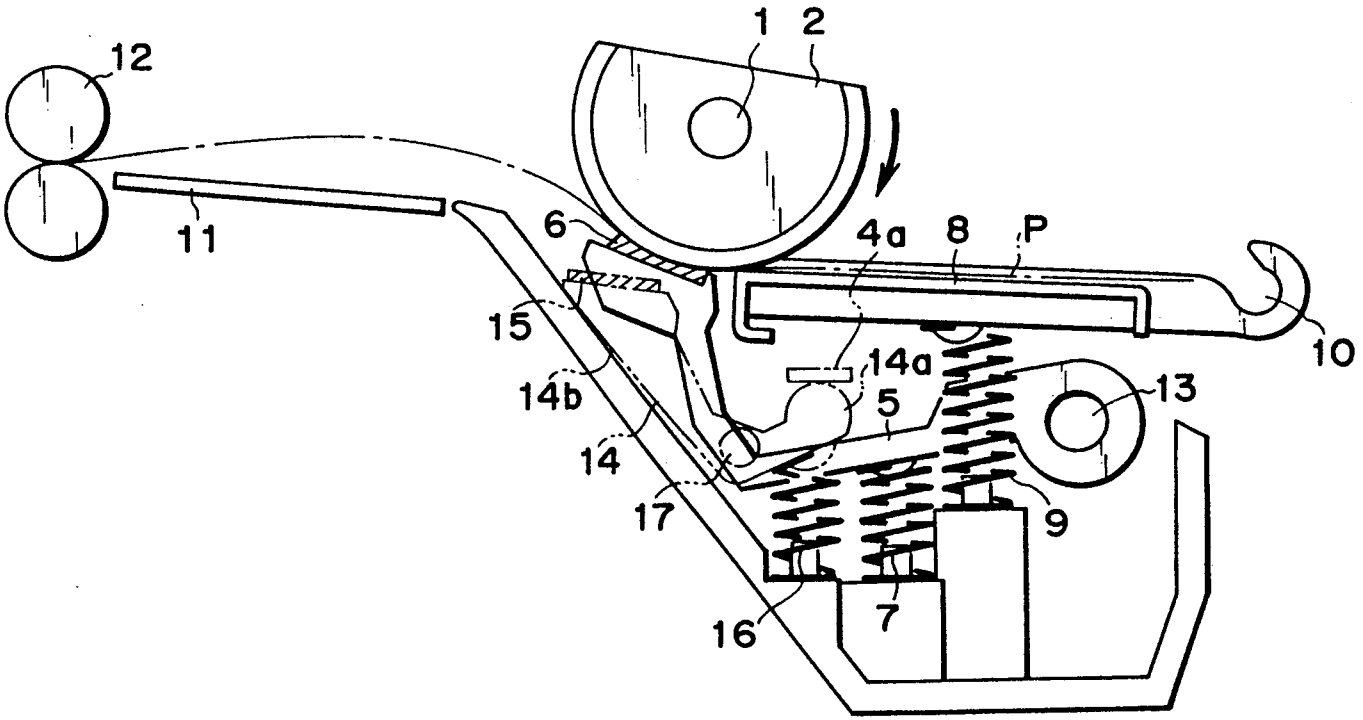
FIG. 11A is a schematic elevational sectional view of a sheet feeding apparatus according to a seventh embodiment of the present invention in a sheet supplying condition.
Figure 11B:
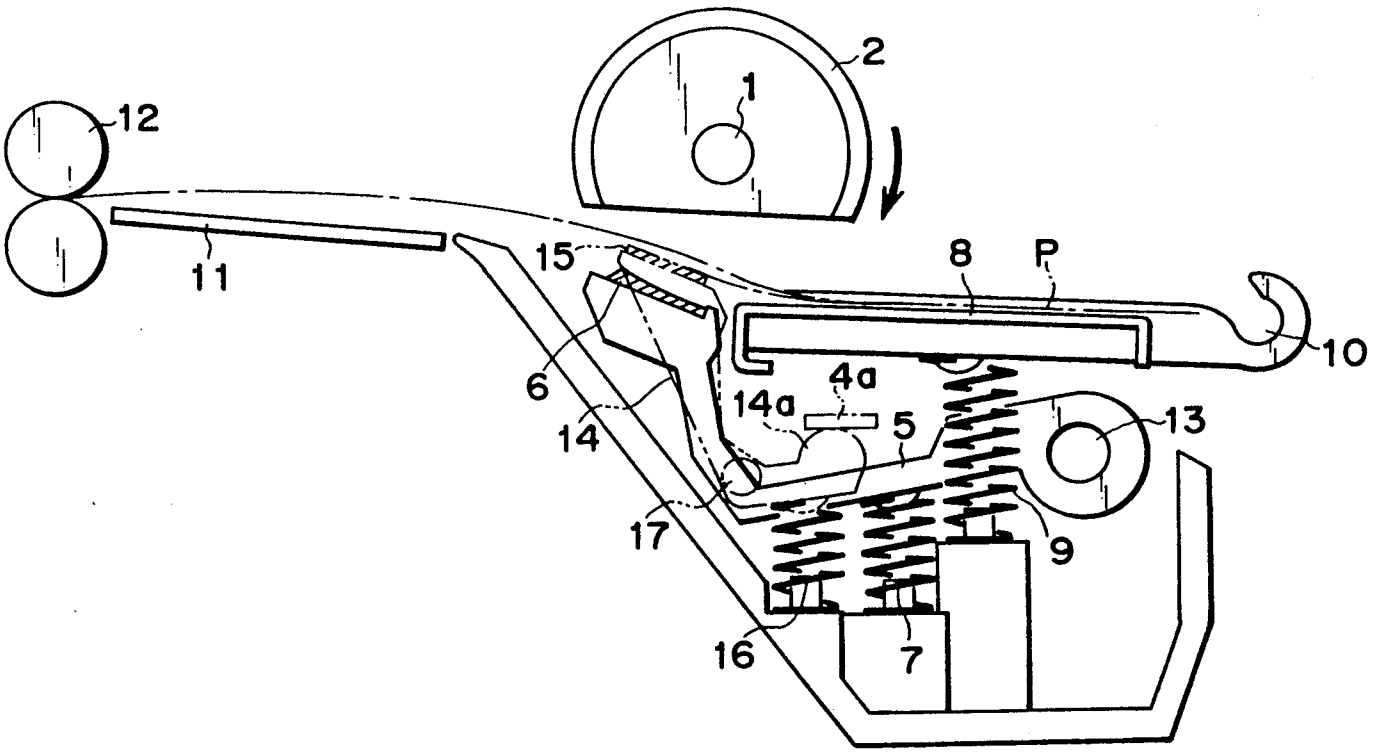
FIG. 11B is a schematic elevational sectional view of the sheet feeding apparatus of FIG. 11A in a condition that the following double feed is prevented.
Figure 12:
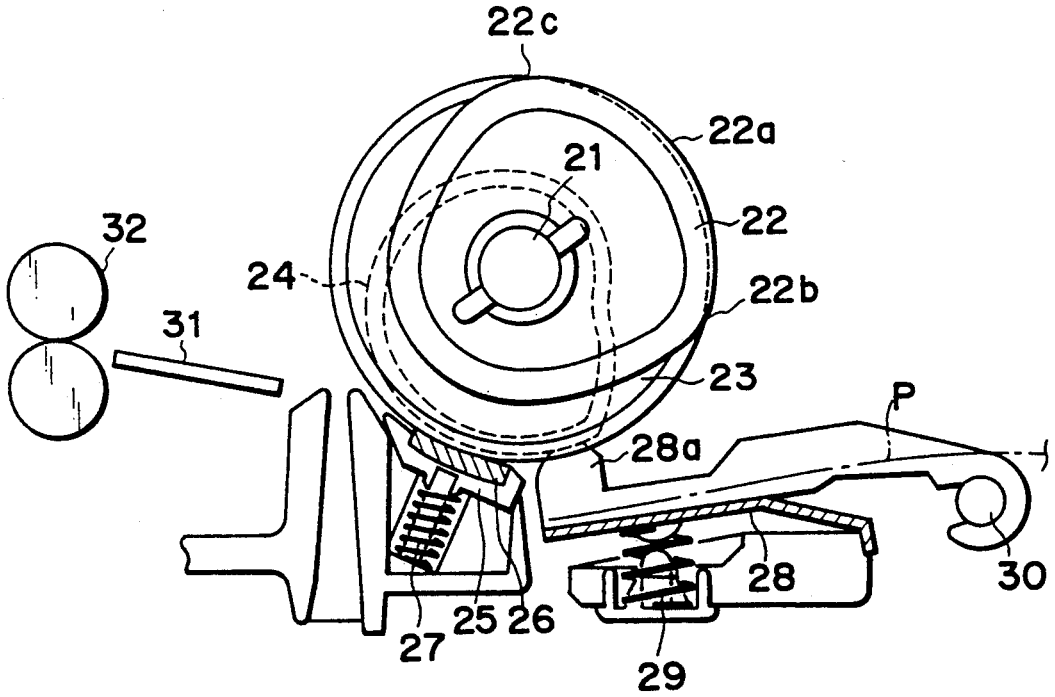
FIG. 12 PRIOR ART
FIG. 12 is a schematic elevational sectional view of a conventional sheet feeding apparatus in a sheet supply waiting condition.
Figure 13:
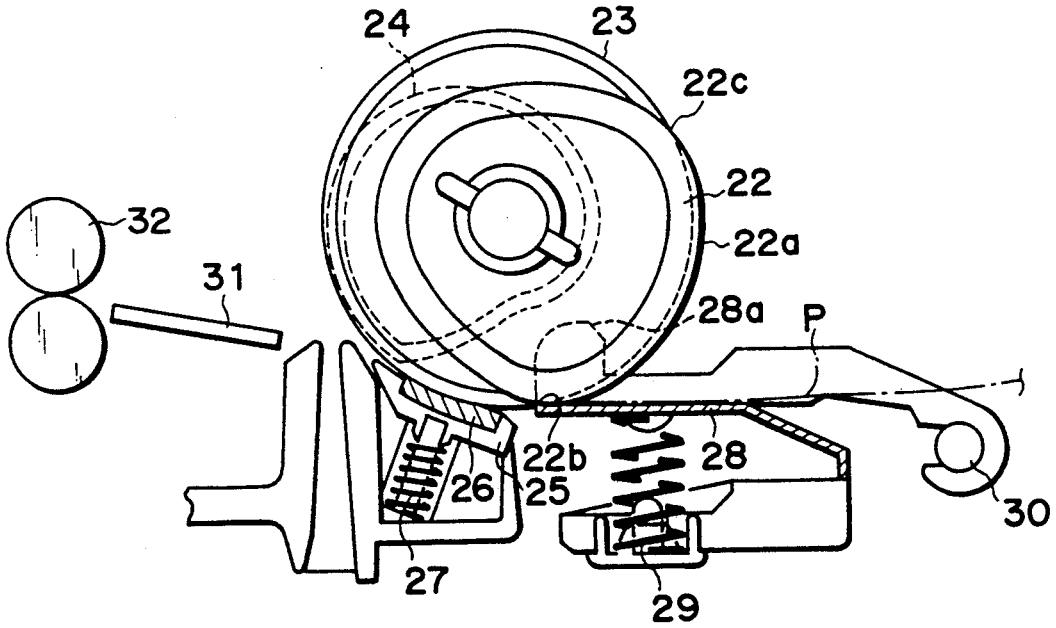
FIG. 13 PRIOR ART
FIG. 13 is a schematic elevational sectional view of the conventional sheet feeding apparatus in a condition that a downward urging force for a sheet stacking plate is released and an eccentric sheet supply roller is abutted against an upper surface of the sheet stacking plate.
Figure 14:
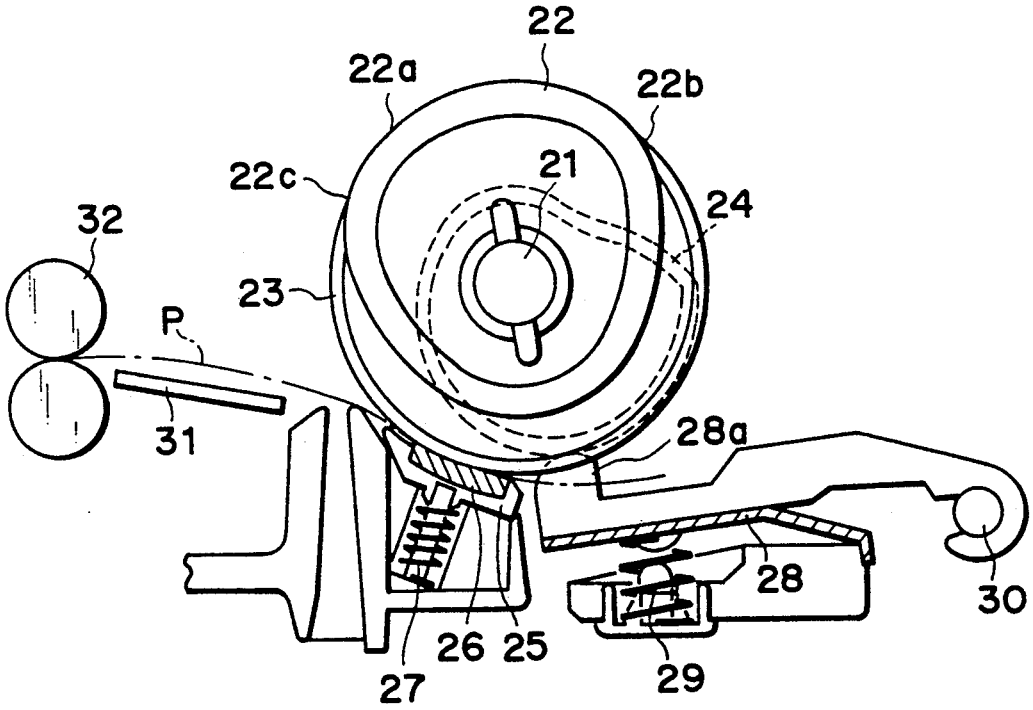
FIG. 14 PRIOR ART
FIG. 14 is a schematic elevational sectional view of the conventional sheet feeding apparatus in a condition that a loop is being formed in a sheet.
Figure 15:
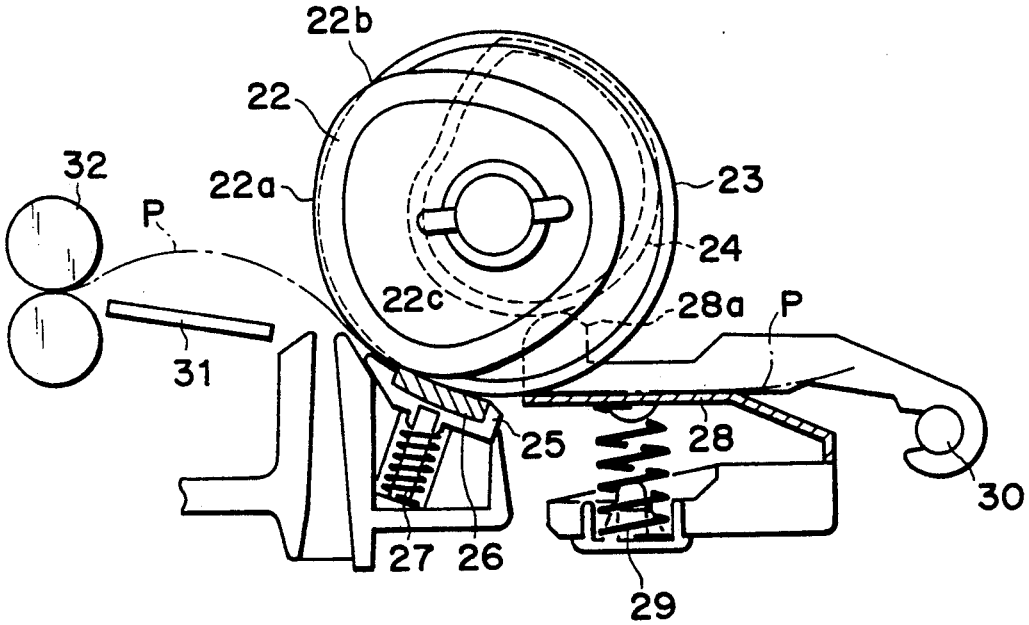
FIG. 15 PRIOR ART
FIG. 15 is a schematic elevational sectional view of the conventional sheet feeding apparatus in a condition that the sheet stacking plate is again urged downwardly.

Next, a seventh embodiment of the present invention will be explained with reference to FIGS. 11A and 11B. In the seventh embodiment shown in FIGS. 11A and 11B, the sheet supply roller 2 is formed as a semi-cylindrical (D-shaped) roller. With this arrangement, as shown in FIG. 11A, the sheet is normally separated and fed one by one by cooperating the sheet supply roller 2 with the separating pad 6. However, as shown in FIG. 11B, when an cut-out portion of the sheet supply roller 2 faces the separating pad 6, the back tension on the sheet is automatically released. When the back tension is released, the sub-separating pad 15 is inserted into the sheet feeding path, thereby preventing the following double feed of the sheets.

Now, although the sheet stacking plate 8 is being biased upwardly by the spring 9, this plate is stopped at a predetermined stop position by a control means (not shown). This stop position is so selected that, when a cylindrical surface portion of the sheet supply roller 2 is contacted with the sheet stacking plate 8, a predetermined sheet supply pressure is obtained.

Similarly, although the separating pad 6 is being biased upwardly by the spring 7, this pad is stopped at a predetermined stop position by a control means (not shown). This stop position is selected so that, when the cylindrical surface portion of the sheet supply roller 2 is contacted with the pad 6, a predetermined sheet separating pressure is obtained.

Further, the sub-separating pad 15 is inserted into the sheet feeding path when the back tension on the sheet is released, by upwardly shifting an urging member 4*a* engaged by an arm 14 by means of a cam (not shown) similar to the eccentric cams 4. In this way, when the semi-cylindrical sheet supply roller 2 is used, it is not needed that the sheet stacking plate 8 and the separating pad 6 are shifted whenever the sheet supply roller 2 is rotated by one revolution.

As mentioned above, since the sheet fed by the conveying means is not subjected to the back tension, even if the sheet feeding apparatus is used with an image forming system, the poor image quality and (or) the discrepancy in image due to the shock generated when the sheet leaves from the sheet supply roller can be avoided. Further, the following double feed can surely be prevented by the action of the following double feed preventing member. In addition, the service lines of the sheet supply roller and the separating pad can be greatly extended.

As in the second embodiment, when the following double feed preventing member is inserted into the sheet feeding path before the pressure of the separating pad is released, the following double feed can be prevented more effectively.

Further, by increasing the number of the following double feed preventing members as in the third embodiment, or by providing the stepped surface on the following double feed preventing member as in the fourth embodiment, the following double feed can be prevented more effectively.

Furthermore, as in the case of the fifth embodiment, since the influence of the back tension acting on the sheet is great, the conventional arrangement cannot be used, and, the technique as in the present invention wherein the back tension does not act on the sheet is inevitable. Of course, also in the fifth embodiment, by incorporating the arrangement or arrangements of the second to fourth embodiments therein, the following double feed can be prevented more effectively.

Further, in the illustrated embodiments, while the separating pad was used as the frictional separating means, other separating means may be used. For example, a retard separating means comprising a retard roller rotated in a direction opposite to a sheet feeding direction and urged against a convey roller rotated in the sheet feeding direction may be used. In this retard separating means, a torque limiter may be interposed in a driving mechanism for the retard roller so that, when a single sheet is introduced between the convey roller and the retard roller, the latter is rotatingly driven in the sheet feeding direction by the movement of the sheet, and when two or more sheets are introduced between the convey roller and the retard roller, the latter is rotated reversely to return the sheets other than the sheet contacting with the convey roller.

What is claimed is:

1. A sheet feeding apparatus, comprising:
sheet supporting means for supporting sheets;
separating means for separating the sheets fed from said sheet supporting means one by one, said separating means comprising rotary feeding means and friction means urged against each other with a predetermined separating pressure to separate the sheets therebetween;
separating pressure releasing means for releasing the separating pressure after the sheets fed from said sheet supporting means are separated by said separating means; and
double feed preventing means insertable into and retractable from a sheet feeding path for the sheet separated by said separating means, said double feed preventing means being inserted into said sheet feeding path for preventing a double feed of the sheets, when the separating pressure is released by said separating pressure releasing means.

2. A sheet feeding apparatus according to claim 1, wherein said double feed preventing means is inserted into said sheet feeding path from a side of the sheets stacked on said sheet supporting means.

3. A sheet feeding apparatus according to claim 2, wherein said double feed preventing means has a surface having high coefficient of friction and facing toward said sheet feeding path.

4. A sheet feeding apparatus according to claim 1, wherein said friction means comprises a separating pad adapted to be urged against said rotary feeding means, and an elastic member for urging said separating pad against said rotary feeding means, and wherein said separating pressure releasing means separates said separating pad from said rotary feeding means.

5. A sheet feeding apparatus according to claim 1, wherein said rotary feeding means feeds out the sheets supported by said supporting means, and said separating pressure releasing means comprises sheet supply pressure releasing means for releasing a sheet supply pressure between said rotary feeding means and the sheets stacked on said sheet supporting means.

6. A sheet feeding apparatus according to claim 5, wherein said sheet supplying means comprises a semicylindrical roller having a cut-out, and wherein, when said cut-out faces said sheet supporting means, the back tension is released.

7. A sheet feeding apparatus according to claim 5, wherein said sheet supporting means comprises a shiftable sheet stacking plate on which the sheets can be stacked, and a biasing means for biasing said sheet stacking plate toward said rotary feeding means to urge the sheets stacked on said sheet stacking plate against said rotary feeding means, and wherein said sheet supply pressure releasing means separates the sheets stacked on said sheet stacking plate from said means rotary feeding in opposition to a biasing force of said biasing means.

8. A sheet feeding apparatus according to claim 7, wherein said rotary feeding means comprises a rotary member for feeding out the sheets by its rotation, and said sheet supply pressure releasing means comprises cam means connected to said rotary member and adapted to shift said sheet stacking plate away from said rotary member in response to the rotation of said rotary member.

9. A sheet feeding apparatus according to claim 7, wherein said double feed preventing means is pivotally supported so that one end thereof can be protruded into said sheet feeding path in response to the separating movement between said sheet supplying means and said sheet stacking plate.

10. A sheet feeding apparatus, comprising:
sheet supporting means for supporting sheets;
sheet supplying means for supplying the sheets supported by said sheet supporting means;
first urging means for urging the sheets supported by said sheet supporting means and said sheet supplying means against each other with a predetermined supply pressure;
frictional separating means for separating the sheets supplied by said sheet supplying means one by one;
second urging means for urging said frictional separating means and said sheet supplying means against each other with a predetermined separating pressure to separate the sheets therebetween;
pressure releasing means for releasing the supply pressure and the separating pressure, after the sheets are separated by said frictional separating means; and
double feed preventing means insertable into and retractable from a sheet feeding path for the sheet separated by said friction separating means, said double feed preventing means being inserted into said sheet feeding path for preventing a double feed of the sheets, when the supply pressure and the separating pressure are released by said pressure releasing means.

11. A sheet feeding apparatus according to claim 10, wherein said frictional separating means comprises a separating pad including a surface having a high coefficient of friction and adapted to be abutted against the sheet.

12. A sheet feeding apparatus according to claim 10, wherein said frictional separating means comprises a rotary member rotated in a direction opposite to a sheet feeding direction, and said rotary member returns the sheets other than the sheet contacting with said rotary conveying means toward said sheet supporting means.

13. A sheet feeding apparatus according to claim 10, wherein said pressure releasing means releases the separating pressure by separating said frictional separating means from said sheet supplying means.

14. A sheet feeding apparatus according to claim 13, wherein said pressure releasing means comprises a cam means attached to said sheet supplying means and adapted to shift said frictional separating means away from said sheet supplying means in response to the rotation of said sheet supplying means.

15. A sheet feeding apparatus according to claim 14, wherein said cam means shifts said sheet stacking plate away from said sheet supplying means in response to the rotation of said sheet supplying means.

16. A sheet feeding apparatus according to claim 15, wherein said pressure releasing means separates said frictional separating means from said sheet supplying means in response to the shift of said sheet stacking plate effected by said cam means.

17. A sheet feeding apparatus according to claim 16, wherein said double feed preventing means is pivotally supported so that one end thereof can be protruded into said sheet feeding path in response to the shift of said sheet stacking plate.

18. A sheet feeding apparatus according to claim 17, wherein said double feed preventing means is provided at its one end with a friction pad having high coefficient of friction.

19. A sheet feeding apparatus according to claim 10, wherein said double feed preventing means has a friction pad having high coefficient of friction and facing toward said sheet feeding path.

20. A sheet feeding apparatus according to claim 19, wherein said friction pad has a stepped surface against which the sheet is abutted.

21. A sheet feeding apparatus according to claim 10, wherein said sheet supporting means comprises a shiftable sheet stacking plate on which the sheets can be stacked, and said first urging means for urging said sheet stacking plate toward said sheet supplying means to urge the sheets stacked on said sheet stacking plate against said sheet supplying means.

22. A sheet feeding apparatus, comprising:

sheet supporting means for supporting sheets;

separating means disposed at an offset position adjacent one lateral edge of the sheet for separating the sheets fed from said sheet supporting means one by one, wherein said separating means comprises rotary feeding means and friction means urged against each other with a predetermined separating pressure to separate the sheets;

conveying means disposed at a downstream side of said separating means and comprising a guide against which one lateral edge of the sheet is abutted to be guided, and a skew-feed means for causing the sheet to abut against said guide;

separating pressure releasing means for releasing the separating pressure after the sheet is separated by said separating means; and double feed preventing means insertable into and retractable from a sheet feeding path for the sheet separated by said separating means, said double feed preventing means being inserted into said feeding path for preventing the double feed of the sheets, when the separating pressure is released by said separating pressure releasing means.

23. A sheet feeding apparatus according to claim 22, wherein said double feed preventing means is inserted into said sheet feeding path from a side of the sheets stacked on said sheet supporting means.

24. A sheet feeding apparatus according to claim 22, wherein said separating pressure releasing means releases the separating pressure by separating said friction means from said rotary feeding means.

25. A sheet feeding apparatus according to claim 22, wherein said rotary feeding means feeds out the sheets supported by said supporting means, and said separating pressure releasing means comprises a sheet supply pressure releasing means for releasing a sheet supply pressure between said rotary feeding means and the sheets stacked on said sheet supporting means.

26. A sheet feeding apparatus according to claim 25, wherein said rotary feeding means comprises a sheet supply roller connected to a driving shaft rotatably supported by side frame of the sheet feeding apparatus.

27. A sheet feeding apparatus according to claim 26, wherein said skew-feed means comprises a convey roller for feeding the sheet in a sheet feeding direction, and a skew-feed roller urged against said convey roller and adapted to feed the sheet obliquely toward said guide.

28. In an image forming system a sheet feeding apparatus comprising sheet supporting means for supporting sheets;

separating means for separating the sheets fed from said sheet supporting means one by one, said separating means comprising rotary feeding means and friction means urged against each other with a predetermined separating pressure to separate the sheets therebetween;

separating pressure releasing means for releasing said separating pressure after the sheets fed from said sheet supporting means are separated by said separating means;

double feed preventing means insertable into and retractable from a sheet feeding path for the sheet separated by said separating means, said double feed preventing means being inserted into said sheet feeding path for preventing a double feed of the sheets, when the separating pressure is released by said separating pressure releasing means.

29. In an image forming system a sheet feeding apparatus comprising sheet supporting means for supporting sheets;

sheet supplying means for supplying the sheets supported by said supporting means;

first urging means for urging the sheets supported by said sheet supporting means and said sheet supplying means against each other with a predetermined supply pressure;

frictional separating means for separating the sheets supplied by said sheet supplying means one by one;

second urging means for urging said frictional separating means and said sheet supplying means against each other with a predetermined separating pressure to separate the sheets therebetween;

pressure releasing means for releasing the supply pressure and the separating pressure, after the sheets are separated by said frictional separating means; and double feed preventing means insertable into and retractable from a sheet feeding path for the sheet separated by said frictional separating means, said double feed preventing means being inserted into said feeding path for preventing a double feed of the sheets, when the supply pressure and the separating pressure are released by said pressure releasing means.

30. In an image forming system a sheet feeding apparatus comprising sheet supporting means for supporting sheets;

separating means disposed at an offset position adjacent one lateral edge of the sheet for separating the sheets fed from said sheet supporting means one by one;

said separating means comprising rotary feeding means and friction means urged against each other with a predetermined separating pressure to separate the sheets conveying means disposed at a downstream side of said separating means and comprising a guide against which one lateral edge of the sheet is abutted to be guided, and a skew-feed means for causing the sheet to abut against said guide;

separating pressure releasing means for releasing the separating pressure after the sheet is separated by said separating means; and double feed preventing means insertable into and retractable from a sheet feeding path for the sheet separated by said separating means, said double feed preventing means being inserted into said feeding path for preventing the double feed of the sheets, when the separating pressure is released by said separating pressure releasing means.

31. A sheet feeding apparatus, comprising:

sheet supporting means for supporting sheets;

separating means for separating the sheets fed from said sheet supporting means one by one, said separating means comprising rotary feeding means and friction means urged against each other with a predetermined separating pressure to separate the sheets therebetween;

conveying means disposed at a downstream side of said separating means for conveying the sheets separated by said separating means;

separating pressure releasing means for releasing the separating pressure after said conveying means starts to convey the sheet;

double feed preventing means insertable into and retractable from a sheet feeding path for the sheet separated by said separating means, said double feed preventing means being inserted into said feeding path for preventing a double feed of the sheets, when the separating pressure is released by said separating pressure releasing means.

32. A sheet feeding apparatus according to claim 31, wherein said double feed preventing means comprises a friction pad insertable into and retractable from a sheet feeding path.

33. A sheet feeding apparatus according to claim 32, wherein said friction means comprises a friction pad urged onto said rotary feeding means, after said conveying means starts to convey the sheet said separating pressure releasing means separates said friction pad of the friction means from said rotary feeding means, and said friction pad of said double feed preventing means is inserted into said feeding path.

34. A sheet feeding apparatus, comprising:

sheet supporting means for supporting sheets;

separating means for separating the sheets fed from said sheet supporting means one by one, said separating means comprising a pair of separating members urged against each other with a predetermined urge force to separate the sheets therebetween;

urge force reducing means for reducing the urge force of said separating member after the sheet is separated by said separating means;

double feed preventing means insertable into and retractable from a sheet feeding path for the sheet separated by said separating means, said double feed preventing means being inserted into said feeding path for preventing the double feed of the sheets, when the urge force is reduced by said urge force reducing means.

35. A sheet feeding apparatus according to claim 34, wherein one of said separating member is a sheet supply member supplying the sheet supported by said sheet supporting means, and the other is a separating pad having a high coefficient of friction.

36. A sheet feeding apparatus according to claim 35, wherein said urge force reducing means reduces the urge force by separating said separating pad from said sheet supply member.

37. A sheet feeding apparatus according to claim 36, wherein said sheet supporting means comprises a shiftable sheet stacking plate on which the sheets can be stacked, and biasing means for biasing said sheet stacking plate toward said sheet supply member.

38. A sheet feeding apparatus according to claim 37, wherein said urge force reducing means shifts said sheet stacking plate away from said sheet supplying member against a biasing force of said biasing means.

39. A sheet feeding apparatus, comprising:

sheet supporting means for supporting sheets;

sheet feeding means for feeding the sheets one by one from said sheet supporting means;

load releasing means for releasing the load generated in the sheet when the sheet is fed from said sheet supporting means by said sheet feeding means;

double feed preventing means insertable into and retractable from a sheet feeding path for the sheet separated by said separating means, said double feed preventing means being inserted into said feeding path for preventing the double feed of the sheets, when the load is released by said load releasing means.

40. A sheet feeding apparatus, comprising:

sheet supporting means for supporting sheets;

sheet feeding means for feeding the sheets one by one from said sheet supporting means;

load releasing means for releasing a load generated in the sheet when the sheet is fed from said sheet supporting means by said sheet feeding means;

double feed preventing means for preventing a double feed of the sheet, said double feed preventing means comprising a protruded portion protruded into the sheet feeding path of the sheet fed from said sheet supporting means to prevent the double feed of the sheet when the load is released by said load releasing means.

* * * * *

UNITED STATES PATENT AND TRADEMARK OFFICE

CERTIFICATE OF CORRECTION

PATENT NO. : 5,253,854

DATED : October 19, 1993

INVENTOR(S) : MASAHIDE TANOUE, ET AL.

It is certified that error appears in the above-indentified patent and that said Letters Patent is hereby corrected as shown below:

COLUMN 3

Line 5, "firstly" should be deleted;

Line 24, "is" should read --are--.

COLUMN 6

Line 27, "synchronous" should read --synchronism--;

Line 34, "anti-clockwise" should read --counter-clockwise--.

COLUMN 7

Line 52, "is" should read --are--.

COLUMN 8

Line 5, "synchronous" should read --synchronism--.

COLUMN 10

Line 15, "an" should read --a--.

UNITED STATES PATENT AND TRADEMARK OFFICE
CERTIFICATE OF CORRECTION

PATENT NO. : 5,253,854

DATED : October 19, 1993

INVENTOR(S) : MASAHIDE TANOUE, ET AL.

It is certified that error appears in the above-identified patent and that said Letters Patent is hereby corrected as shown below:

COLUMN 12
Line 11, "means rotary feeding" should read --rotary feeding means--;
Line 47, "friction" should read --frictional--.

COLUMN 14
Line 22, "comprising" should read --comprising:--;
Line 42, "comprising" should read --comprising:--.

COLUMN 15
Line 2, "comprising" should read --comprising:--;
Line 56, "sheet said" should read --sheet, said--.

COLUMN 16
Line 17, "member" should read --members--.

Signed and Sealed this

Thirty-first Day of May, 1994

*Attest:*

Bruce Lehman

BRUCE LEHMAN

*Attesting Officer*

*Commissioner of Patents and Trademarks*